US005609414A

United States Patent [19]

Caluori

[11] Patent Number: 5,609,414

[45] Date of Patent: Mar. 11, 1997

[54] RECESSED LIGHTING FIXTURE

[75] Inventor: Giuseppe Caluori, Dollard-des-Ormeaux, Canada

[73] Assignee: Canlyte Inc., Lacine, Canada

[21] Appl. No.: 562,571

[22] Filed: Nov. 24, 1995

[51] Int. Cl.[6] ..... F21S 1/06

[52] U.S. Cl. ..... 362/366; 362/365; 248/343; 248/27.1

[58] Field of Search ..... 362/364, 365, 362/366, 368, 147, 148, 289; 248/343, 27.3, 27.1

[56] References Cited

U.S. PATENT DOCUMENTS

| | | | |
|---|---|---|---|
| 2,965,348 | 12/1960 | Gerstel et al. | 248/343 |
| 4,250,540 | 2/1981 | Kristofek | 248/27.1 |
| 4,293,895 | 10/1981 | Kristofek | 248/27.1 |
| 4,733,339 | 3/1988 | Kelsall | 362/365 |
| 5,068,772 | 11/1991 | Shapiro et al. | 248/343 |
| 5,314,148 | 5/1994 | Jones | 248/343 |
| 5,377,088 | 12/1994 | Lecluze | 362/366 |

*Primary Examiner*—Ira S. Lazarus
*Assistant Examiner*—Thomas M. Sember
*Attorney, Agent, or Firm*—Mark B. Eisen

[57] ABSTRACT

The invention provides a recessed lighting fixture having an outwardly extending housing flange about a lower end of the fixture housing and retaining clips mounted to the housing wall. The retaining clips have enlarged ends trapped within the housing and extending through axial slots so as to permit axial movement along the housing wall. Each retaining clip includes a spring arm biased to an open position in which the spring arm extends radially from the housing, part of the upper portion being flexible such that the spring arm can be depressed toward the housing wall. The fixture can thus be installed through a ceiling opening barely larger than the diameter of the housing. An adjusting screw is provided for adjusting the position of the retaining clip axially along the housing wall, which secures the housing in place by clamping the ceiling between the housing flange and the retaining clips.

19 Claims, 3 Drawing Sheets

RECESSED LIGHTING FIXTURE

FIELD OF INVENTION

This invention relates to light fixtures. In particular, this invention relates to a recessed light fixture having adjustable retaining clips for securing the fixture to a ceiling.

BACKGROUND OF THE INVENTION

Recessed light fixtures, often called "pot lights", are in widespread use in residential and commercial premises. They appeal to designers both for the fact that they take up virtually no space in a room, being recessed into the ceiling, and for their aesthetic versatility and appeal.

A typical recessed light fixture comprises a housing, which is usually cylindrical, a socket for receiving a floodlight, halogen bulb or other lamp, and a housing trim for aesthetic purposes which is affixed over the mouth of the housing after the housing has been mounted into the ceiling and covers the housing flange.

Conventionally the housing is attached either directly to a joist or to cross-piece nailed between joists specifically for supporting the light fixture, or is provided with a mounting frame that is affixed to adjacent joists. Affixing the housing directly to a joist can be difficult, because the confined space within the housing does not allow for a screw or nail driving tool to approach at the proper angle, and alignment of the fixture so that it is flush with the ceiling can therefore be difficult to achieve.

If the fixture is to be mounted in the ceiling other than immediately beside a joist, either a cross-piece or a mounting frame is required to support the fixture. This presents the disadvantage during construction of a room that additional materials and labour are required to mount the fixture, and after the fixture is mounted the finishing panels (eg. wall board, ceiling tile etc.) must be measured so that an opening for the fixture is cut in the correct position, before the panel is affixed to the ceiling. Since the opening in the finishing panel must be barely larger than the diameter of the housing, in order to ensure that the housing flange will properly abut the ceiling, there is little margin for error.

Even more difficulty is encountered in retrofitting a recessed light fixture into a finished ceiling. A large piece of the ceiling panel must be cut away so that the cross-piece or mounting frame can be secured to the joists. The ceiling panel must be replaced once the housing is properly mounted, with a piece having a hole which is just larger than the housing diameter and cut in the proper position. This is a very labour-intensive process.

It would be advantageous in all of these situations to be able to mount the fixture without having to secure it to a joist, cross-piece or mounting frame. However, the cylindrical shape of the housing makes this problematic, because one must pass it through the opening cut for the fixture before securing the housing in place, and if the opening has been cut properly there is no clearance left around the housing to work within the ceiling.

SUMMARY OF THE INVENTION

The present invention overcomes these problems by providing a pair of resilient retaining clips attached to the housing in a "butterfly" orientation. The clips are designed to be spring-biased to an open position, in which they extend radially outwardly from the housing, but can be depressed to a closed position in which the clips recede into the housing to allow the housing to pass through an opening in the ceiling panel which is barely larger than the housing. Once the clips have cleared the opening they return to their open position and prevent the fixture from dropping out of the opening.

The clips are adjustable, so that the housing can be raised until the housing flange properly abuts the ceiling panel and the fixture is thereby secured, the ceiling panel being essentially clamped between the clips and the housing flange. The adjustability of the retaining clips also allows a lighting fixture embodying the invention to accommodate ceiling panels of varying thicknesses. The entire mounting process can be effected through an opening just larger than the diameter of the housing, and the fixture is held securely in place by the ceiling panel itself. Thus, to install a light fixture of the invention into a finished ceiling there is no need to locate joists (other than to ensure that the intended position of the fixture does not impinge on a joist), to affix any separate supporting means to the joists, to affix the housing to any supporting structure within the ceiling or to pre-measure openings for the fixture in the ceiling panel. This results in a tremendous savings in labour and material costs.

The present invention thus provides a recessed lighting fixture comprising a housing having a top and a housing wall with an outwardly extending housing flange about a lower end thereof, a retaining clip mounted to the housing wall, the retaining clip being mounted so as to permit axial movement along the housing wall and comprising an upper portion having a neck extending to a spring arm and an anchoring portion, the spring arm being biased to an open position in which the spring arm extends radially from the housing, part of the upper portion being flexible such that the spring arm can be depressed toward the housing wall, and means for preventing a lower portion of the spring arm from radially extending beyond an outer limit, and means for adjustably fixing the retaining clip to an axial position along the housing wall.

The invention further provides, for a recessed lighting fixture comprising a housing having a top and a housing wall with an outwardly extending housing flange about a lower end thereof, a retaining clip comprising an upper portion having a neck extending to a spring arm and an anchoring portion, the spring arm being biased to an open position in which the spring arm extends radially from the housing, part of the upper portion being flexible such that the spring arm can be depressed toward the housing wall, and means for preventing a lower portion of the spring arm from radially extending beyond an outer limit, whereby the retaining clip can be mounted to the housing wall so as to permit axial movement along the housing wall and to fix the retaining clip in an axial position along the housing wall.

BRIEF DESCRIPTION OF THE DRAWINGS

In drawings which illustrate byway of example only a preferred embodiment of the invention.

DETAILED DESCRIPTION OF THE INVENTION

Figure 1:
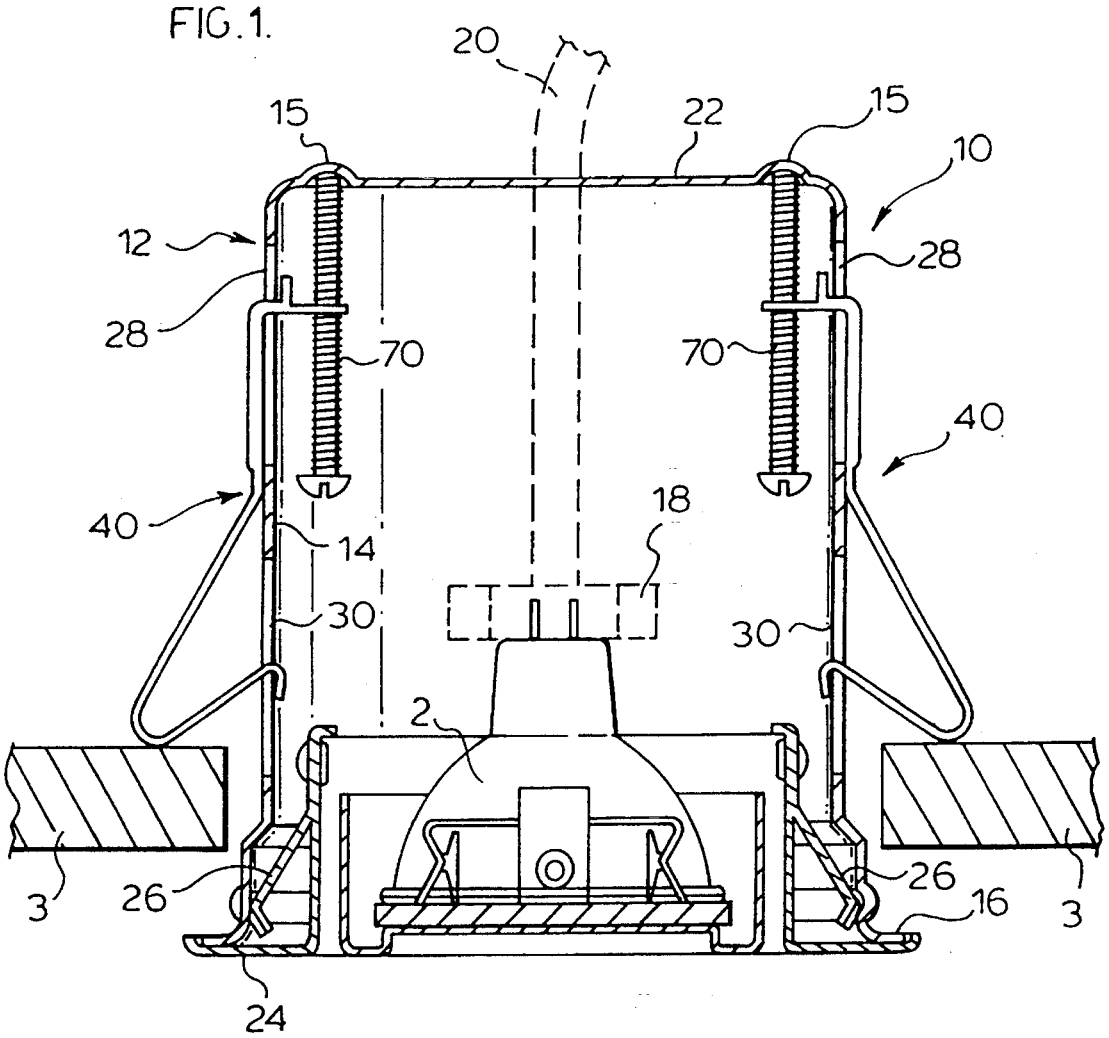
FIG. 1 is a cross section of a recessed light fixture embodying the invention with the retaining clips in a rest (open) position.

Referring to FIG. 1, the recessed fixture 10 has a housing 12 comprising a cylindrical side wall 14 terminating in an outwardly extending housing flange 16 about the mouth of the housing 12. An electrical socket 18 for receiving a lamp 2 such as a floodlight or halogen lamp or the like, is attached to an electrical supply wire 20 of the appropriate rating (shown in phantom in FIG. 1) which egresses from the housing 12 through an opening in the top 22. The wire 20 may lead to a socket cup or other covered receptacle (not shown) screwed or bolted on top of the housing for enclosing the electrical connections with the mains power supply. A housing trim 24 is affixed to the mouth of the housing 12 by clips 26, springs (not shown) or any other conventional means.

The improvement comprises a pair of retaining clips 40, illustrated in FIGS. 4 to 7, mounted so as to permit axial movement along the housing wall 14. Preferably the retaining clips 40 are slidably secured to the housing wall 14 through slots 28, 30. Each clip 40 is preferably formed from a strip of resilient metal or plastic and comprises a lower portion having a spring arm 42 which in a rest (open) position extends at an oblique angle from the housing wall, terminating in an elbow 46 which defines the lower limit of the retaining clip 40.

Means is provided for preventing the spring arm 42 from extending radially beyond an outer limit, in a preferred embodiment comprising a return arm 48 which extends from the elbow 46. The return arm 48 terminates in an enlarged end, in the embodiment shown a wing 50, which is wider than the slot 30. This allows the spring arm 42 to be depressed toward the housing wall 14, while preventing the spring arm 42 from over-extending when the housing 12 is engaged to a ceiling panel as described below.

An upper portion of the retaining clip 40 includes a bearing portion 44 extending to a neck 52 which is narrower than the slot 28 and is bent generally orthogonally relative to the bearing portion 44. The neck 52 terminates in an anchoring flange 54, which is wider than the slot 28. The anchoring flange 54 includes a threaded hole 58 for receiving an adjusting screw 70 and a pair of ears 56 which protect the housing wall 14 from the sharp edges of the anchoring flange 54.

In order for the spring arm 42 to be depressed toward the housing wall 14, a point of flexure 43 is provided between the spring arm 42 and the bearing portion 44. Although in the preferred embodiment the entire retaining clip 40 is formed from a resilient material, strictly speaking the retaining clip 40 only needs to be flexible at the point of flexure 43. The neck 52 is preferably provided with a strengthening rib 60 swaged into the neck 52, to resist flexing at the neck 52 as the retaining clip 40 is adjusted in the manner described below.

Figure 2:
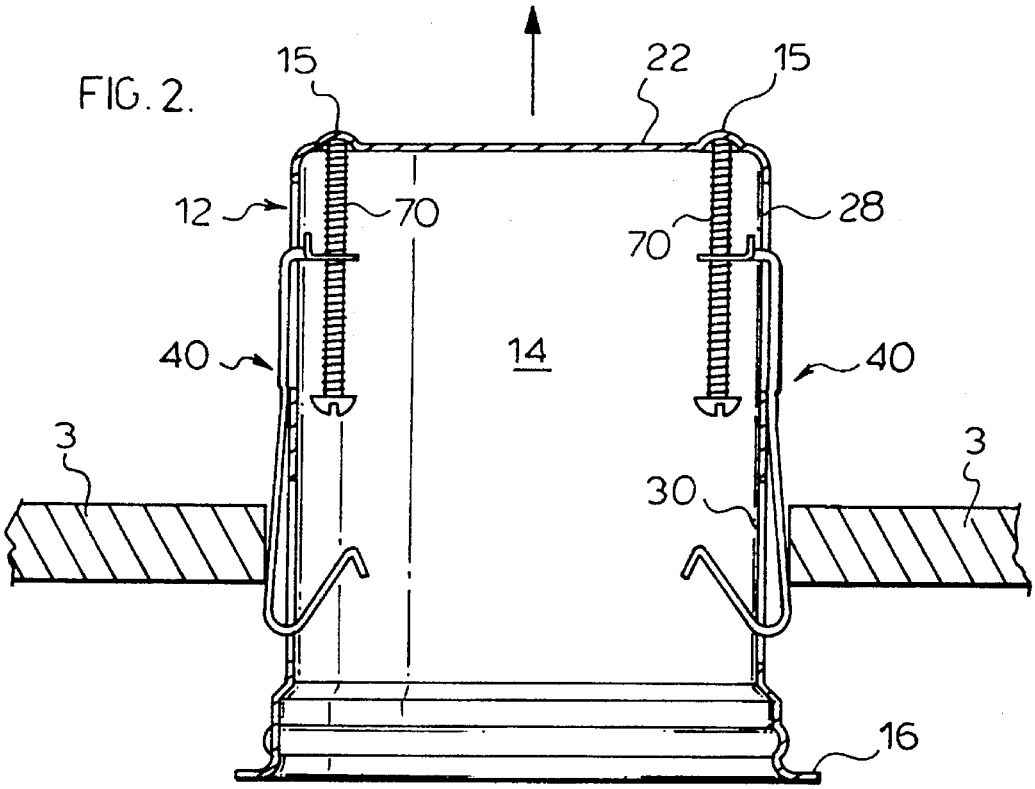
FIG. 2 is a cross section of the light fixture of with the retaining clips in a depressed (closed) position.
Figure 3:
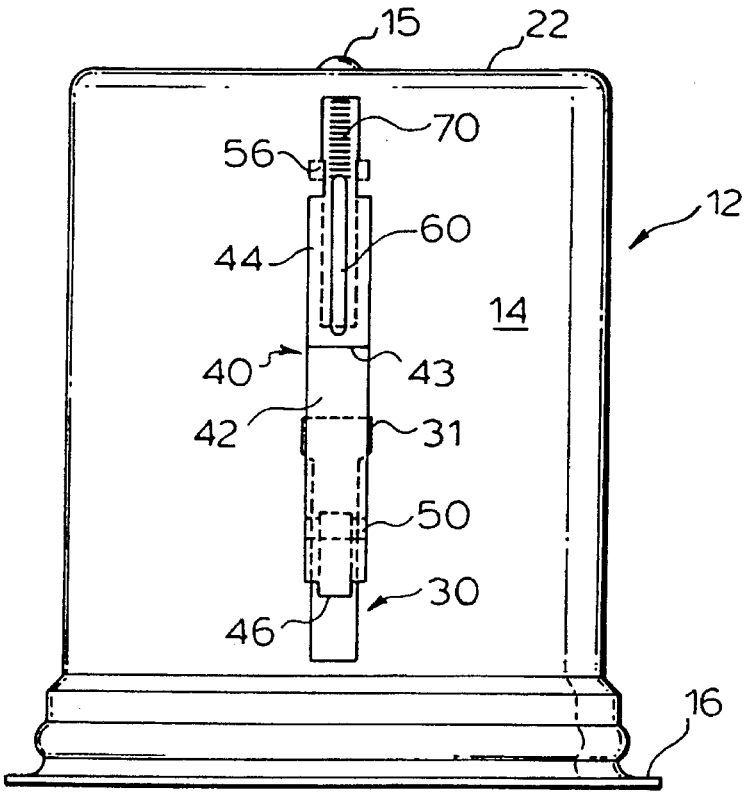
FIG. 3 is a side elevation of the housing showing the positioning of the clip on the housing.
Figure 4:
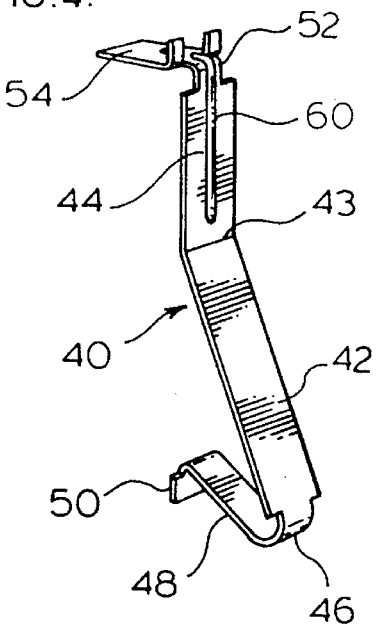
FIG. 4 is a perspective view of a retaining clip.
Figure 5:
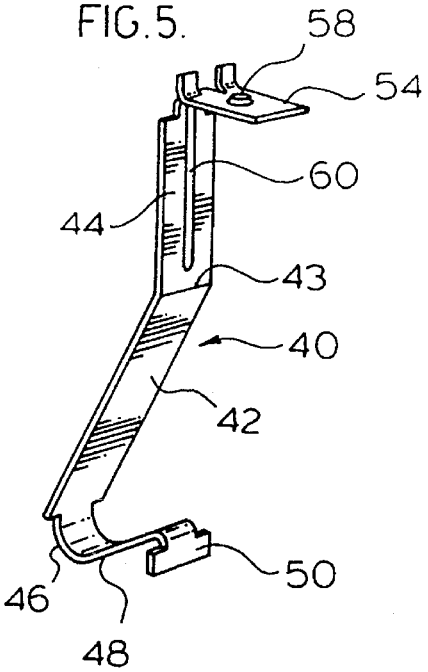
FIG. 5 is a perspective view taken opposite FIG. 4.

As best seen in FIGS. 1 to 3, the housing 12 is provided with upper and lower slots 28, 30, cut or stamped out of the housing wall 14 and spaced apart axially. It is also possible to provide the invention using a single slot extending axially along the housing wall 14, however the middle portion of the slot would not be used and it is accordingly preferable to use two slots 28, 30 as shown, separated by a web of housing wall for strength. Preferably slots 28, 30 are provided at both sides of the housing 12, allowing two retaining clips 40 to be mounted in a "butterfly" fashion.

A retaining clip 40 is secured to the housing 12 by holding the clip 40 sideways and inserting the anchoring flange 54 into the slot 28. The clip 40 is then turned upright, the return arm 48 is compressed slightly and the wing 50 is inserted into a widened portion 31 provided at the upper end of the slot 30 (shown in FIG. 3). Deformation of the retaining clip 40 to mount it on the housing 12 can be done manually, and because of its resilience the clip 40 will return to its original shape as soon as manual pressure is released. So mounted, the retaining clip 40 can slide axially along the housing wall 14, the neck 52 trapped in the slot 28 and the return arm 48 trapped in the slot 30.

To ensure a secure installation and in order to accommodate ceiling panels 3 of varying thicknesses, means is provided for adjustably fixing the retaining clip 40 to an axial position on the housing wall 14. Each clip 40 is anchored to the housing 12 by an adjusting screw 70 disposed through the threaded hole 58. The foot of the screw 70 is trapped in a recess 15 formed in the top 22 of the housing 12, as seen in FIGS. 1 and 2. Thus, as the adjusting screw 70 is rotated in the clockwise direction the retaining clip 40 is forced downwardly along the wall 14 of the housing 12. The anchoring flange 54 and ears 56 trap the upper end of the clip 40 and the wing 50 traps the lower end of the clip 40, so that the clip 40 slides along the housing 12 with the bearing portion 44 remaining essentially flat against the wall 14.

The spring arm 42 can thus be depressed toward the housing wall 14, and the wing 50 will recede into the housing 12 as shown in FIG. 1. It will be noted that the entire length of the return arm 48 is narrower than the slot 30, allowing the clip 40 to be substantially fully depressed. The ears 56 bear against the inner surface of the housing wall 14 as the spring arm 42 is depressed and prevent dislodgement of the upper portion of the clip 40. The bearing portion 44 is wider than the slot 28 and therefore bears against the outer surface of housing wall 14 surrounding the slot 28 as the spring arm 42 is depressed, which keeps the spring arm 42 biased toward its rest position.

Figure 6:
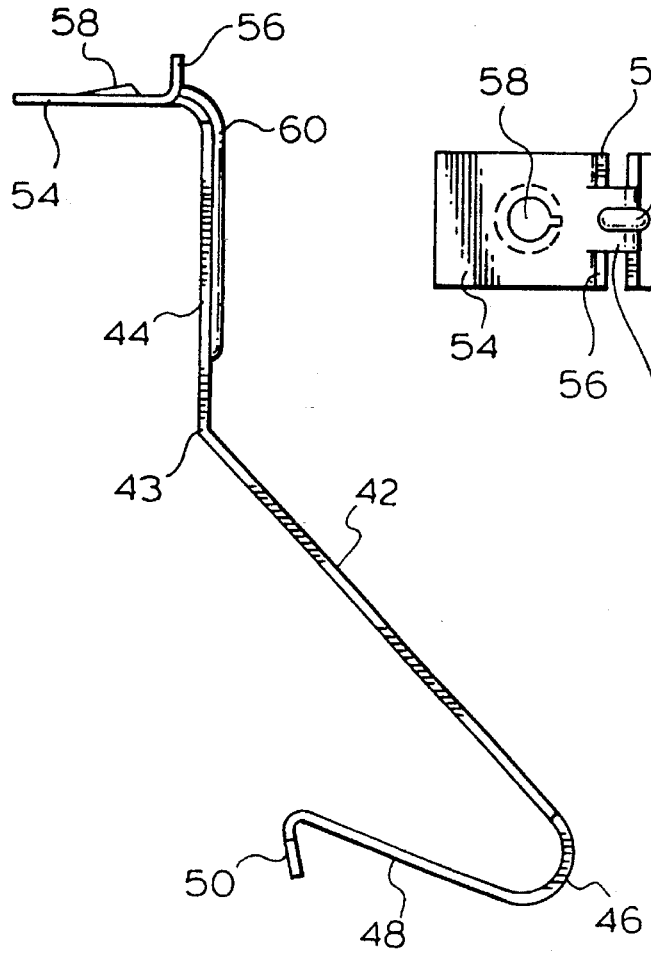
FIG. 6 is a side elevation of the retaining clip.
Figure 7:
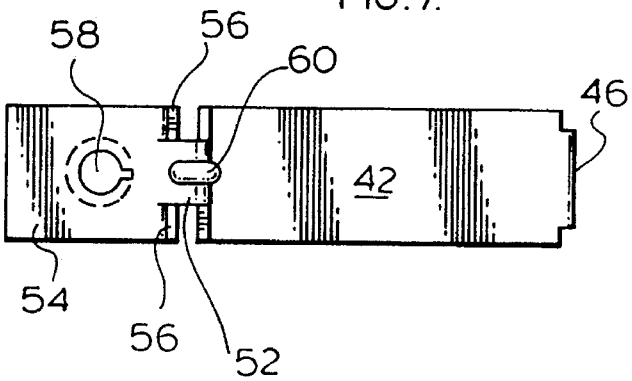
FIG. 7 is a top plan view of the retaining clip.

As can be seen in FIG. 6, before mounting the spring arm 42 is oriented at about 135° relative to the bearing portion 44, and preferably the wing 50 is slightly offset from the bearing portion 44 so that the spring arm 42 is always under a slight tension in its rest (open) position mounted to the housing 12. Thus the wing 50 and ears 56 always bear against the inner surface of the housing wall 14 even when the clip 40 is in the rest (open) position.

In use, a pair of retaining clips 40 are mounted to the housing 12 as described above, and the adjusting screws are rotated until the neck 52 of each clip 40 is near the upper limit of the slot 28. Once the installer completes the necessary electrical connections for the socket 18, the top 22 of the housing 12 is inserted into the ceiling opening and the housing 12 is pushed into the ceiling. The ceiling panel 3 contacts the spring arms 42 of the retaining clips 40, and as the housing 12 is pushed further into the ceiling opening the spring arms 42 are depressed to the closed position, as shown in FIG. 2. As soon as the elbow 46 of each clip 40 has cleared the ceiling panel 3, the spring arms 42 snap back to the rest (open) position and prevent the housing 12 from dropping out of the ceiling opening, as shown in FIG. 1.

With the housing 12 being supported by the retaining clips 40 resting on the top surface of the ceiling panel 3, the installer then rotates the adjusting screws 70 to force the anchoring flanges 54 away from the top 22 of the housing 12, which has the effect of raising the housing 12. As the housing flange 16 comes into contact with the bottom (exposed) surface of the ceiling panel 3, the elbows 46 of the retaining clips 40 clamp down on the top surface of the ceiling panel 3. The resilience of the retaining clips 40 allows the adjusting screws 70 to be "over tightened" somewhat, and the retaining clips 40 will deform accordingly and apply greater pressure to the ceiling panel 3, fixing the housing 12 securely in place; the return arms 48 and wings 50 prevent the spring arms 42 from overextending or collapsing as the housing 12 is secured to the ceiling panel 3. The installer then attaches the housing trim 24 in conventional fashion and inserts the lamp 2 into the socket 18.

It will be appreciated that the above description of the invention describes details of the preferred embodiment only. It is preferred that the retaining clips 40 be mounted on the housing 12 in diametric opposition, but this is not strictly necessary; that each retaining clip be mounted into two axially aligned slots 28, 30, but a single slot or other means in which the clips 40 can slide relative to the housing 12 will also be effective; that the entire retaining clip be stamped from a single strip of resilient material, but only the point of flexure 43 between the spring arm 42 and the bearing portion 44 needs to be flexible, and other means such as a leaf spring or compression spring may be employed to bias the clip 40 to the open position. These and other modifications which will be apparent to those skilled in the art may be made without departing from the scope of the invention as defined by the appended claims.

I claim:

1. A recessed lighting fixture comprising a housing having a housing wall with an outwardly extending housing flange about a lower end thereof, a retaining clip mounted to the housing wall, the retaining clip being mounted so as to permit axial movement along the housing wall and comprising an upper portion having a neck disposed through a slot in the housing wall and extending to a spring arm and an anchoring portion, the spring arm being biased to an open position in which the spring arm extends radially from the housing, part of the upper portion being flexible such that the spring arm can be depressed toward the housing wall, and means for preventing a lower portion of the spring arm from radially extending beyond an outer limit, and means for adjustably fixing the retaining clip to an axial position along the housing wall comprising an adjusting screw bearing against a surface of the housing and disposed through a threaded opening in the anchoring portion.

2. The fixture of claim 1 wherein the retaining clip includes a bearing portion for bearing against an outer surface of the wall of the housing as the spring arm is depressed.

3. The fixture of claim 2 wherein the part of the upper portion which is flexible comprises a point of flexure between the bearing portion and the spring arm.

4. The fixture of claim 1 wherein means for preventing a lower portion of the spring arm from radially extending beyond an outer limit comprises a return arm extending from the spring arm and terminating at an enlarged end disposed inside the housing.

5. The fixture of claim 4 wherein the return arm extends from an elbow which defines a lower limit of the spring arm.

6. The fixture of claim 4 wherein the upper portion of the retaining clip is mounted to the housing wall through a first axial slot in the housing wall which is narrower than the anchoring portion and the lower portion of the retaining clip is mounted to the housing wall through a second axial slot in the housing wall which is narrower than the enlarged end.

7. The fixture of claim 1 wherein the flexible part is resilient and the spring arm is biased to the open position thereby.

8. The fixture of claim 1 including a plurality of retaining clips.

9. A retaining clip for a recessed lighting fixture comprising a housing having a housing wall with an outwardly extending housing flange about a lower end thereof, the retaining clip comprising an upper portion having a neck extending to a spring arm and an anchoring portion, the spring arm being biased to an open position in which the spring arm can extend radially from the housing, part of the upper portion being flexible such that the spring arm can be depressed toward the housing wall, and means for preventing a lower portion of the spring arm from radially extending beyond an outer limit, whereby the retaining clip can be adjustably mounted to the housing wall by means comprising an adjusting screw bearing against an inner surface of the housing and disposed through a threaded opening in the anchoring portion.

10. The retaining clip of claim 9 wherein the retaining clip includes a bearing portion for bearing against an outer surface of the wall of the housing as the spring arm is depressed.

11. The retaining clip of claim 10 wherein the part of the upper portion which is flexible comprises a point of flexure between the bearing portion and the spring arm.

12. The retaining clip of claim 9 wherein means for preventing a lower portion of the spring arm from radially extending beyond an outer limit comprises a return arm extending from the spring arm and terminating an an enlarged end disposed inside the housing.

13. The retaining clip of claims 12 wherein the return arm extends from an elbow which defines a lower limit of the spring arm.

14. A lighting fixture for recessing into a panel, comprising a housing having a housing wall with an outwardly extending housing flange about a lower end thereof, a retaining clip mounted to the housing wall, comprising an upper portion extending to a spring arm and an anchoring portion for anchoring the upper portion of the clip to an upper portion of the housing wall, the spring arm being biased to an open position in which the spring arm extends radially from the housing and being movable such that the spring arm can be depressed toward the housing wall, and means cooperating with the housing for preventing a lower portion of the spring arm from radially extending beyond an outer limit comprising a return arm extending from an elbow, the elbow defining a, lower limit of the retaining clip and the return arm terminating at an enlarged end disposed inside the housing which recedes into a lower portion of the housing when the spring arm is depressed, wherein the elbow rests against the panel when the fixture is recessed, to prevent dislodgement of the fixture from the panel.

15. The fixture of claim 14 wherein the upper portion of the retaining clip terminates in an anchoring portion having neck disposed through an axial slot in the housing wall so as to permit axial movement of the retaining clip along the housing wall.

16. The fixture of claim 15 wherein the retaining clip includes a bearing portion for bearing against an outer surface of the wall of the housing as the spring arm is depressed.

17. The fixture of claim 15 including means for adjustably fixing the retaining clip to an axial position along the housing wall comprising an adjusting screw bearing against a surface of the housing and disposed through a threaded opening in the anchoring portion.

18. The fixture of claim 14 wherein the upper portion of the retaining clip is mounted to the housing wall through a first axial slot in the housing wall which is narrower than the anchoring portion and the lower portion of the retaining clip is mounted to the housing wall through a second axial slot in the housing wall which is narrower than the enlarged end.

19. The fixture of claim 14 including a plurality of retaining clips.

* * * * *